United States Patent [19]

Bogert

[11] 4,045,932

[45] Sept. 6, 1977

[54] JOINT SYSTEM FOR WALL PANEL CONSTRUCTION

[76] Inventor: Allen Z. Bogert, Panacres, Pipersville, Pa. 18947

[21] Appl. No.: 703,514

[22] Filed: July 8, 1976

[51] Int. Cl.[2] ..... E04C 2/00

[52] U.S. Cl. ..... 52/460; 52/241; 52/468; 52/489; 52/498

[58] Field of Search ..... 52/459–468, 52/481, 498, 241, 359, 489

[56] References Cited

U.S. PATENT DOCUMENTS

| | | | |
|---|---|---|---|
| 1,826,133 | 10/1931 | Hatch | 52/468 X |
| 3,307,309 | 3/1967 | Bloxsom | 52/465 X |
| 3,553,915 | 1/1971 | Passovoy | 52/460 X |

FOREIGN PATENT DOCUMENTS

| | | | |
|---|---|---|---|
| 202,340 | 7/1956 | Australia | 52/461 |

*Primary Examiner*—J. Karl Bell

*Attorney, Agent, or Firm*—Dorfman, Herrell and Skillman

[57] ABSTRACT

A joint system for wall panel construction, particularly adapted for use with metal studs. The system provides a batten cover element which is positioned to overlie the junctions between panels of a wall panel structure having butt joints, inside corners, and/or outside corners. The system of the invention utilizes a receiver element which is adapted to be fastened to the framework studs which underlie the junction, the receiver element having a portion which projects outwardly between the panels and terminates in a locking flange. The receiver element is identical for all junctions and separate batten cover elements cooperate with the locking flange to cover the junctions, the batten element having one form for a butt joint, a second form for an inside corner, and a third form for an outside corner, each form providing one wing having a locking channel to receive the locking flange of the receiver and adapted to overlie one panel and a second wing to overlie the other panel. The receiver and batten elements have sufficient resilience to snap into place and interlock against inadvertent displacement, the resilience also affording intentional displacement to enable disassembly of the joint.

11 Claims, 4 Drawing Figures

JOINT SYSTEM FOR WALL PANEL CONSTRUCTION

The present invention is directed to wall panel construction in which pre-formed panel elements are mounted on a framework. The invention is particularly directed to a batten joint system for such structures which provide a batten strip or cover element to extend along and overlie the junction between adjacent panels.

Wall construction wherein the structure is composed of panel elements mounted in edge-to-edge relation on a framework is becoming universally accepted as a desirable method of erecting and installing interior partitions. In this type of construction, pre-formed panel elements are mounted on frameworks with their edges adjoining and the joint between adjacent panel elements is covered by suitable means. If a plaster wall is simulated, the cover means consists of a tape which spans the joint and is finished so that when the wall is painted or otherwise decorated, the tape and the joint become invisible. Another commonly used structure utilizes cover strips along the junctions which overlie and conceal the edges of the panels, but do not render the joint invisible. The latter construction is particularly useful in temporary and knockdown partitions.

The framework on which the panels are mounted, particularly in vertical walls, consists of horizontal toe and cap plates at the bottom and top of the partition and vertical studs extending therebetween. In wooden frameworks, the framework is nailed together into a rigid structure, and normally the panel elements are tacked to the wooden framework, the panels being cut and arranged on the framework so that each joint is backed by a vertical stud. In metal frameworks, on the other hand, the perimeter of the framework is rigidly united but the intermediate studs are free for limited displacement so that the fasteners which are secured to the stud at predetermined positions may be adjusted relative to the panel by adjusting the studs, after assembly the panels serving as a structural component to rigidly position the studs.

With the foregoing in mind, the present invention provides a novel joint system which is particularly adapted to mounting panels on a metal framework.

A primary object of the invention is to provide a system for covering the panel junctions of structures which include butt joints, inside corners and outside corners, the system employing a common receiver element which may be used on any one of these junctions and suitable cover elements cooperable with said common receiver, and designed to accommodate a particular form of junction.

Another object of the invention is to provide a system of the stated type in which the receiver and cover elements are cooperable to resiliently interlock providing a snap-in assembly which is resistant to inadvertent displacement and disassembly.

The system of the present invention also provides an arrangement which facilitates erection and assembly of wall panel structures by relatively unskilled labor and which provides a satisfactory finished appearance to the construction.

In particular, the present invention provides a wall panel system including a novel receiver element having means for positioning itself on a stud or suitable backing element so as to provide a base portion underlying the junction edge of one of the panel elements, a web adapted to project outwardly midway of the front surface of the stud between the adjacent panel elements of the junction, and a locking flange on the receiver parallel to the base portion and cooperable with a locking channel on a batten cover element which extends along the junction and covers the marginal portions of the adjoining panel elements therealong.

These and other objects of the invention are more fully set forth hereinafter with reference to the accompanying drawing, wherein.

Figure 4:
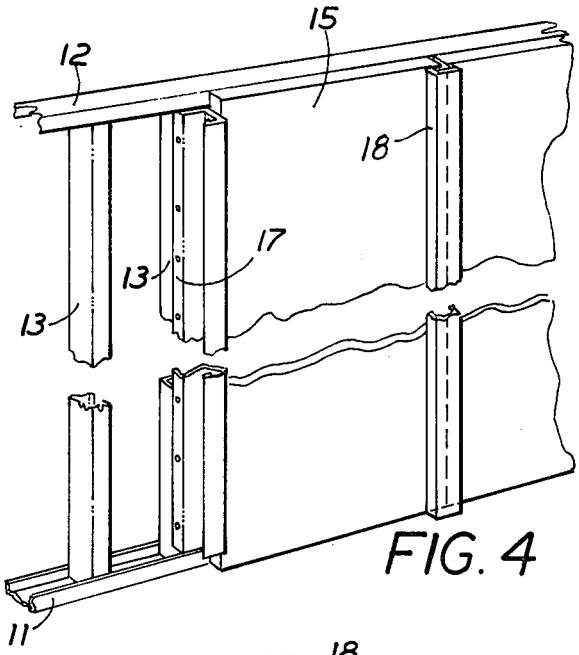
FIG. 4 is a fragmentary thumbnail view illustrating the assembly of panel members to a framework in accordance with the present invention.

Referring now to the drawing, and particularly to FIG. 4, the illustrated wall panel construction is a dry wall structure comprising a framework having a toe strip 11, a cap strip 12 and a series of vertical support elements or studs 13. In the present instance, the toe and cap strips comprise channel elements which are rigidly interconnected at their opposite ends to form a rigid framework on which panel elements 15 may be mounted. The stud elements 13 are engaged in the channels of the toe and cap strips for limited adjustment along the length of the strip. In accordance with the invention, the support or stud 13 which underlies each junction between adjacent panels 15 is provided with a receiver element 17, and the junction between the panels is covered by a batten element or cover strip 18 which is engaged with the receiver 17 and is held in place thereon. FIG. 4 does not illustrate the details of the receiver and batten, nor does it illustrate the coves or moldings which are provided along the upper and lower marginal edges of the panel elements, since these details of the drywall structure may be any one of a number of conventional or non-conventional devices which are beyond the scope of the present invention.

Figure 1:
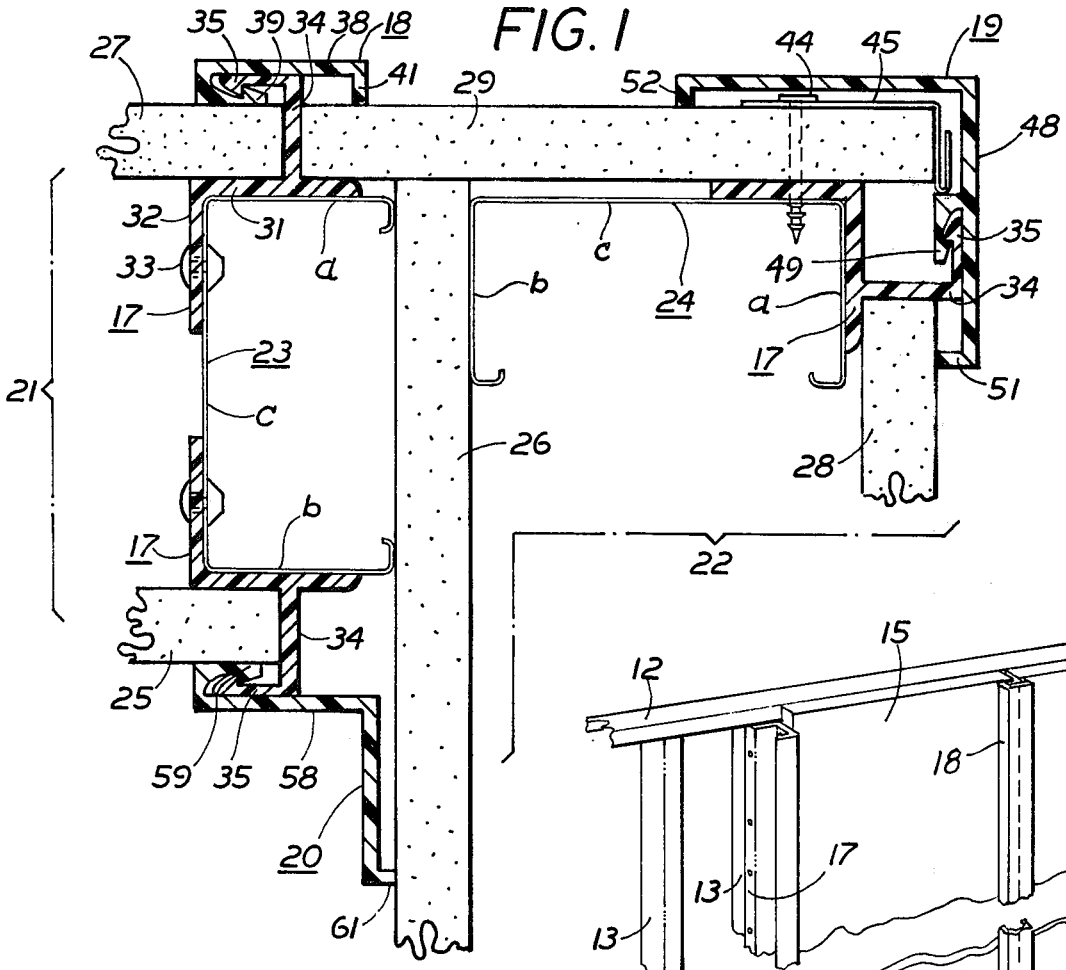
FIG. 1 is a sectional view in a horizontal plane illustrating a dry wall partition arrangement having butt and corner joints forming junctions embodying the present invention.

The details of the stud 13, receiver element 17 and batten cover element 18 are best shown in FIG. 1 which is a transverse sectional view of a corner of a drywall structure illustrating three separate joint configurations. The structure shows a corner arrangement between two double-faced walls designated 21 and 22 in FIG. 1. The outside face of the wall 21 serves to close the end of the wall 22, whereas the inside face of the wall 22 serves to close the end of the wall 21. At the end of the wall 21, a vertical metal stud of channel form is provided, as shown at 23, and at the end of the wall 22, a similar stud is provided at 24. These studs 23 and 24 are conventional metallic studs having front and back webs confronting the interior surfaces of the wall panels to support the same, and a base or side web intermediate the front and back webs. In FIG. 1, the outer web at the front of each stud is designated *a*, the inner web is designated *b*, and the base web is designated *c*. The inner and outer panel elements of the wall 22 are designated 26 and 28, respectively, and the inner panel of wall 21 is designated 25 and the outer panels of the wall 21 are designated 27 and 29. The structure shown in FIG. 1 embodies three joint configurations: an inside corner junction between the panels 25 and 26, an outside corner junction between the panels 28 and 29, and a butt-joint junction between the panels 27 and 29.

In accordance with the present invention, an improved joint system is effective to cover each of the junctions shown in FIG. 1. The system embodies a receiver element 17 which extends along the length of the junction between adjacent panel elements, the receiver elements 17 being of identical configurations in each of the junctions shown. The cover element, in the present instance, has a separate configuration for each junction. For the butt joint between the panels 27 and 29, the cover element is in the form of a batten strip 18 identical to that shown in FIG. 4. For the outside corner between the panels 28 and 29, the cover strip is in the form as shown at 19 and for the inside corner covering the junction between the panels 25 and 26, the cover strip is in the form shown at 20. In each case, the cover element interlocks with the receiver element 17 to overlie the adjoining marginal edges of the respective panels and thereby cover the joint between the panels.

The receiver element 17 includes a base portion 31 which is designed to bear flush against the front web *a* of the stud and anchoring flange 32 is formed integrally with the base portion and extends at right angles thereto, as shown, to lie flush against the side *c* of the stud. When mounted in this fashion, the base 31 is firmly and rigidly mounted in a predetermined position on the stud. The outer surface of the base portion 31 provides seating surfaces which are mounted in face-to-face confronting relation to the marginal portions of the panels. A series of suitable fasteners is provided at 33 to anchor the flange 32 to the stud throughout its length.

In accordance with the invention, a mounting web projects perpendicularly from the base portion as indicated at 34 and extends outwardly therefrom a distance greater than the thickness of the panel elements. With the receiver 17 firmly positioned by the anchoring flange 32, the mounting web 34 extends along the center line of the front *a* of the stud so as to provide means for centering the stud along the length of the joint between adjacent panels. Thus, when the mounting web 34 is positioned between the panels 27 and 28, for example, and the junction edges of the panels abut the mounting web, the stud is centered to underlie substantially equal marginal portions of the panels 27 and 29 along the junction.

Beyond the outer surface of the panels 27 and 29, the mounting web 34 is provided with a terminal locking flange 35 which extends parallel to the base portion 31, preferably in the same direction as the anchoring flange 32. The locking flange 35 terminates in a tapered latch portion having an inwardly-directed hook. The length of the mounting web 34 relative to the thickness of the panel 27 provides a predetermined clearance between the inner surfaces of the flange 35 and the exterior surface of the panel 27 when the panel is seated flush against the outer seating surface of the base 31.

The batten cover strip 18 is designed to interlock with the receiver element 17 so that it fills the predetermined clearance space between the flange 35 and the panel 27 and retains the panel flush against the exterior seating surface of the base 31. To this end, the batten element 18 includes an outer wall portion 38 designed to parallel the base portion 31. Along one side edge of the cover element 18, the element is formed with a locking wall 39 which cooperates with the outer wall 38 to form a locking channel which receives the locking flange 35. At the entrance end of the channel formed between the webs 38 and 39, the locking web 39 is formed as a keeper notch which cooperates with the hook of the latch portion of the flange 35 to interlock the element and retain the locking wall 39 firmly in position between the locking flange 35 and the exterior surface of the panel 27. The thickness of the locking wall fills the clearance space between the locking flange and the panel 27 so as to firmly retain the panel against the outer seating surface of the base 31. The opposite side edge of the batten element 18 is provided with a continuous toe portion 41 having a width corresponding to the exterior dimension of the channel formed between the walls 38 and 39 so that the toe portion 41 bears against the outer surface of the panel 29 and retains the panel 29 flush against the outer seating surface of the base 31 on the other side of the mounting web 34. When installed in this fashion, the locking wall 39 provides one wing of of the cover element to engage the panel 27 along its margin, and the toe portion 41 provides a second wing to engage the panel 29 along its margin. The common outer wall 38 of the two wings is parallel to the coplanar outer surfaces of the panels 27 and 29.

Figure 2:
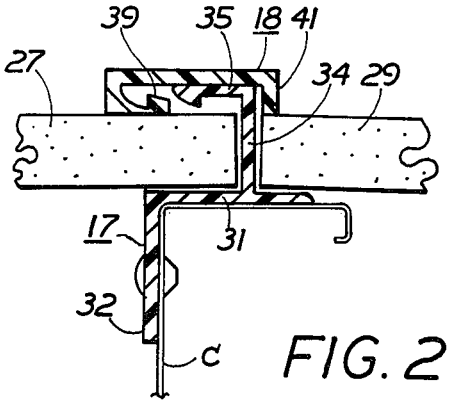
FIGS. 2 and 3 are fragmentary views illustrating the assembly of a butt joint between panel elements in accordance with the present invention.
Figure 3:
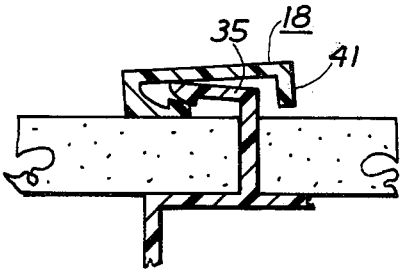

The tapered form of the keeper portion of the locking wall 39 cooperates with the tapered form of the latch portion of the locking flange 35 so that the elements may be snapped together into place, as shown in FIGS. 2 and 3. Referring to these figures, the batten cover element 18 may be disposed against the outer surfaces of the panels 27 and 29 with the toe 41 disposed adjacent the intermediate mounting web 34. The batten element 18 may thereupon be displaced parallel to the panels to engage the channel upon the locking flange 35 until the keeper portion of the locking wall 39 engages the latch portion of the flange 35, as shown in FIG. 3. The material of the elements 17 and 18 has a resilient stiffness so as to permit flexure of the elements, as shown in FIG. 3, permitting the latch portion to interlock with the keeper portion. In the forcible displacement of the batten element 18 as shown, the receiver element 17 is held firmly in place by the bearing of the anchoring flange 32 against the side wall *c* of the stud. The interengagement of the batten element with the receiver element provides a secure assembly which is not subject to inadvertent displacement or dislodgment. However, when it is decided to disassemble the joint, the resilience of the material forming the elements 17 and 18 permits intentional disengagement. The disengagement is effected by prying the toe portion 41 away from the outer surface of the panel, as shown in FIG. 3, preferably starting at a free end of the assembly and when displaced in this fashion, the strip 18 may be moved parallel to the locking flange 35 in a direction to disengage the hook of the latch portion from the keeper portion of the wall 39. Once started, the continuous extent of the hook and latch portions along the length of the elements provide a camming action which permits complete disassembly of the two elements. With the cover element removed from the receiver element, the panels may be removed for disassembly or replacement.

In assembling a continuous wall of a plurality of abutted edge-to-edge panels, the wall is assembled from right to left, as shown in the figures, so that the right-hand panel is anchored in place by the joint along the righthand edge of the panels. With this panel in place, referring to FIG. 4, the stud 13 with the receiver 17 mounted thereon will underlie the free lefthand edge of the panel. The loose mounting of the stud permits the stud to be displaced tight against the free juncture edge of the panel 15 so that the base 31 of the receiver strip underlies the free marginal portion on the undersurface of the panel which is in place. With the mounting web 34 flush against the free edge of the panel, the locking flange 35 faces away from the installed panel so that the locking flange and the base portion provide a channel into which the marginal portion of the next panel may loosely fit. The fitting of this righthand edge portion into the channel provides limited support for the next panel so that the laborer doing the installation may leave the panel unattended while installing the studs at the lefthand edge. Retaining the panel upright and in place, enables the laborer to release the panel so that he may attend to other matters and work with the necessary materials to anchor the panel properly. With the two panels abutting the mounting web 34, the batten strip 18 may be snapped into place and the resilient nature of the batten strip firmly anchors the panels flush against the seating surfaces provided on the base portion 31 of the receiver.

The outside and inside corners, respectively, are assembled in a similar manner using the cover elements 19 and 20, respectively, in conjunction with the reciever 17. As shown in FIG. 1, the outside-corner cover element 19 is designed to accommodate the panel elements 28 and 29 when positioned as shown, with the panel element 29 confronting the side *c* of the stud and the panel element 28 confronting the front *a*. The receiver element 17 is secured to the stud 24 in the standard fashion with the anchoring flange 32 flush against the side *c* of the stud. At the corner, the panel 24 may be permanently attached to the stud 24 by a fastener which penetrates the anchoring flange 32 and the side *c* of the stud. In addition to providing protection for the edge of the panel at the outside corner, a protective corner element is secured thereto as indicated at 45. With the mounting web 34 positioned centrally of the front *a* of the stud, the panel element 29 does not abut the opposite surface of the web 34 as the panel element 28 does. In the present instance, the outer wall of the cover element 19 comprises an angular member 48 having one wing adapted to lie flush against the locking flange 35 of the receiver 17 and overlie the panel 28, and a second wing to overlie the margin of the panel 29. At the free edge of each wing, the wall 48 is formed with toe elements 51 and 52, respectively, which perform the same function as the toe element 41 of the cover element 18. The cover element 19 is provided with a locking wall 49 which is parallel to the outer wall 48 to define a locking channel therebetween to receive the locking flange 35 of the receiver 17. The locking wall 49 is identical to the locking wall 39 of the cover element 19 so as to provide a firm interlock with the latch portion of the locking web 35. In this instance, the locking wall 49 does not wedge itself between a panel element and the locking flange 35 as does the web 35, but in other respects the functional operation of the cover strip is identical. The locking wall interlocks with the locking flange to retain the cover strip 19 in place against inadvertent displacement but the resilience of the material forming the elements permits intentional disengagement when desired.

The inside-corner junction between the panels 25 and 26 is similar to the outside corner. In this instance, the stud 23 is mounted against the panel 26 so that the side *c* is spaced away from the panel 26. This arrangement positions the locking flange 35 of the receiver 17 so that it extends away from the mounting web 34 in a direction remote from the panel 26. The cover element 20 in this instance includes an angular outer wall 58 in the form of an inside corner having at the free edge of one wing a toe portion 61 bearing against the panel 26 in a manner similar to the toe portions 41 and 51. At the side edge of the other wing of the angular wall 58, a back-turned locking wall 59 cooperates with the outer wall 58 to define a locking channel therebetween which receives the locking flange 35 of the receiver. The wall 59 has a keeper portion similar to the keeper portions of the previously described cover strips so that it may cooperate with the latch portion of the locking flange 35.

The joint system of the present invention is particularly adapted for knockdown structures in which the panels are held in place solely by the receiver and cover element and any molding strips extending around the periphery of each panel. If desired, the security afforded by these elements may be supplemented by additional fastening means, including standard fasteners and/or cement or other adhesives. Thus, the invention is not limited to the use of the receiver and cover elements as the sole retainers for the panel elements, although the illustrated embodiment of the invention contemplates such usage.

While particular embodiments of the invention have been herein illustrated and described, it is not intended to limit the invention to such disclosure but changes and modifications may be made therein and thereto within the scope of the following claims.

I claim:

1. Wall panel construction including a plurality of panels disposed in edge-to-edge relation along a junction, a framework for supporting said panels, said framework having a support stud underlying the junction of said panels and extending along the length of said junction, a receiver mounted on said support stud having a base portion confronting at least one of said panels and having a seating surface in face-to-face abutting relationship with the interior surface of said one panel along the junction edge thereof, a mounting web extending perpendicularly from said base portion disposed intermediate said panels along the length of said junction, said web projecting from said base portion a distance greater than the thickness of said panels, the end of said web outermost from said base portion having a pre-formed integral locking flange extending therefrom parallel to said base portion with its interior surface spaced from the seating surface of said base portion by a distance equal to the thickness of the panel plus a predetermined clearance, said pre-formed locking flange and the seating surface of said base portion providing a channel into which the marginal portion of one of the panels may loosely fit during assembly, and a cover element for said junction substantially coextensive in length with said receiver and having two wings respectively adapted to overlie the adjacent edges of the panels comprising the junction, one wing of said cover element having a locking channel on its undersurface adapted to receive said locking flange, said locking channel being defined between an outer wall of said cover strip and an inner locking wall substantially parallel to said outer wall, the thickness of said locking wall corresponding to said predetermined clearance so that after assembly when said locking channel is engaged with said locking flange, the space between said seating surface and said locking wall is equal to the thickness of said one panel and the marginal portion of said one panel fits tightly between said seating surface and said locking wall.

2. Wall panel construction according to claim 1 wherein said outer wall of said cover element has an inturned continuous toe portion extending along a side edge of said cover element remote from said locking channel to bear against the underlying panel element and retain it against the seating surface of said base portion of said cover element.

3. Wall panel construction according to claim 2 wherein the said toe portion is spaced from said locking channel a distance greater than the length of said locking flange so as to permit lateral displacement of said cover element parallel to said locking flange a distance sufficient to position said flange between said toe portion and said locking channel and to permit full disengagement of said locking flange from said locking channel.

4. Wall panel construction according to claim 3 wherein the thickness of said toe portion along one side of said exposed wings corresponds to the combined thickness of said locking channel and said inner and outer walls.

5. Wall panel construction according to claim 1 wherein said wings are coplanar to cover a butt-joint junction.

6. Wall panel construction according to claim 1 wherein the wings of said cover element are angularly disposed to cover a corner-joint junction.

7. Wall panel construction according to claim 1 including complementary releasable locking means on said locking flange and in said locking channel to releasably retain said elements in engagement.

8. Wall panel construction according to claim 7 wherein said locking flange comprises a hook latch, and said channel includes a keeper portion, at least one of said flange and channel being formed of resilient material to afford releasable interlocking thereof.

9. Wall panel construction according to claim 1 wherein said base portion has an anchoring flange extending perpendicularly therefrom in a direction opposite to said mounting web, said base portion thereby adapted to seat against the front and one side of the support stud, the distance between said anchoring flange and said mounting web disposing said mounting web medially of the front of said support stud.

10. Wall panel construction according to claim 9 wherein said locking flange extends from the mounting web toward the side of the support stud which seats the anchoring flange.

11. A receiver for mounting cover elements on a support stud in a wall panel construction comprising a base portion having one surface adapted to seat on the front of the stud and an opposite surface providing aligned seating surfaces for wall panel elements, an anchoring flange extending from said one surface perpendicular to said base portion to seat on one side of the stud, a mounting web extending from said opposite surface perpendicular to said base portion intermediate said aligned seating surfaces and spaced parallel to said anchoring flange to project outwardly from the medial portion of the stud, said mounting web terminating in a pre-formed integral locking flange disposed parallel to said base portion and projecting perpendicular to said web toward said anchoring flange to provide a channel between one of said seating surfaces and said locking flange adapted to receive the edge of a wall panel element, said locking flange having at its free end remote from said web a latch portion adapted to releasably interlock with the cover element.

* * * * *